US005188056A

United States Patent [19]

Bonnet

[11] Patent Number: 5,188,056

[45] Date of Patent: Feb. 23, 1993

[54] PLEASURE BOAT WITH SAILS OR MOTOR

[76] Inventor: Claude Bonnet, 42 Rue des Vals 42160, Andrezieux Boutheon, France

[21] Appl. No.: 659,419

[22] PCT Filed: Jul. 4, 1990

[86] PCT No.: PCT/FR90/00505

§ 371 Date: Mar. 11, 1991

§ 102(e) Date: Mar. 11, 1991

[87] PCT Pub. No.: WO91/00821

PCT Pub. Date: Jan. 24, 1991

[30] Foreign Application Priority Data

Jul. 11, 1989 [FR] France ..... 89 0966

[51] Int. Cl.[5] ..... B63B 8/10; B63B 3/00; B63B 7/04; B63B 5/24

[52] U.S. Cl. ..... 114/355; 114/343; 114/352; 114/357; 114/123

[58] Field of Search ..... 114/355, 359, 173, 356, 114/357, 358, 343, 352, 177, 178

[56] References Cited

U.S. PATENT DOCUMENTS

| | | | |
|---|---|---|---|
| 2,360,554 | 10/1944 | Englert | 114/178 |
| 2,384,966 | 1/1945 | Rowland | 114/356 |
| 2,666,933 | 1/1954 | Engensperger | 114/352 |
| 3,085,262 | 7/1960 | Plemmons | 114/355 |
| 3,133,294 | 5/1964 | Kunz | 114/357 |
| 3,465,480 | 9/1969 | Rohn | 114/356 |
| 3,556,038 | 1/1971 | Wolfe | 114/173 |
| 3,559,221 | 1/1968 | Juhnke | 114/356 |

*Primary Examiner*—Jesus D. Sotelo
*Assistant Examiner*—Kenneth Lee
*Attorney, Agent, or Firm*—Eckert Seamans Cherin & Mellott

[57] ABSTRACT

Pleasure boat with a sail or motor comprising a hull and a deck separated by an interface, remarkable insofar along the outlying perimeter of the interface on the hull and/or on the deck, it has one or more shaped indentations which, when the hull and the deck are brought together and assembled, are capable of defining a frame to receive elements forming a subframe and arranged so as to form portholes.

10 Claims, 2 Drawing Sheets

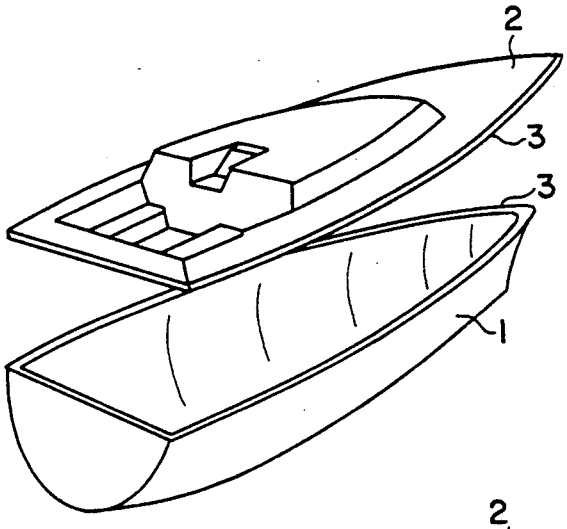
FIG. 1
FIG. 2
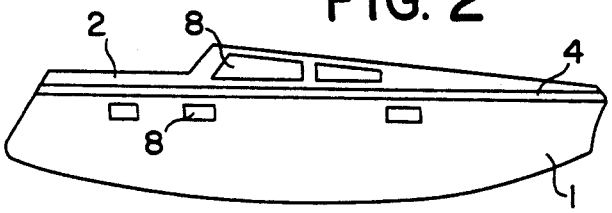
FIG. 3
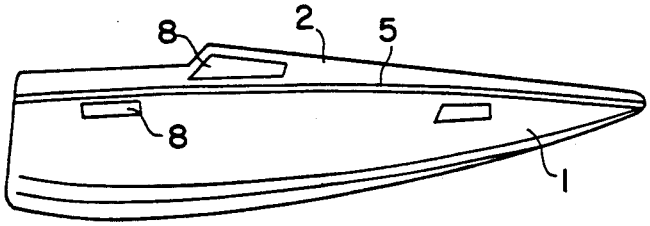
FIG. 4
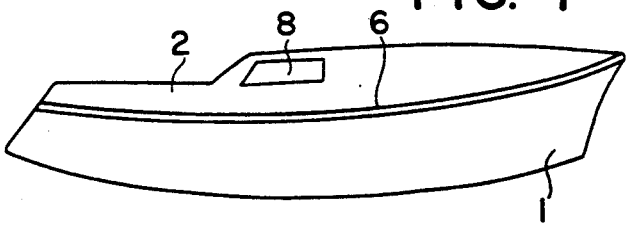
FIG. 5
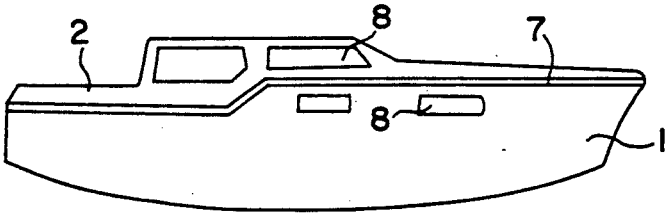

FIG. 6
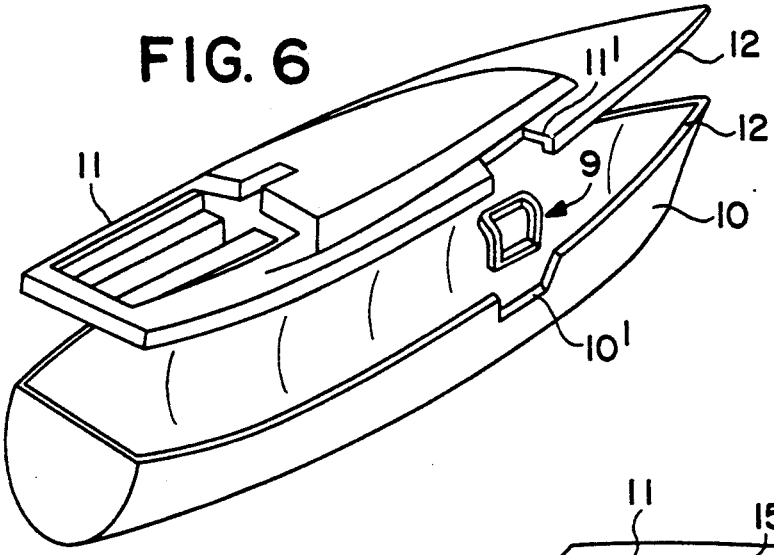
FIG. 7
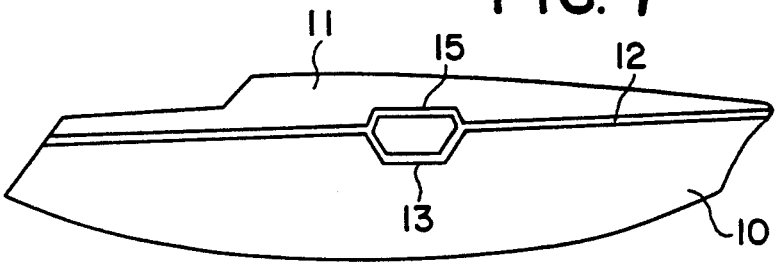
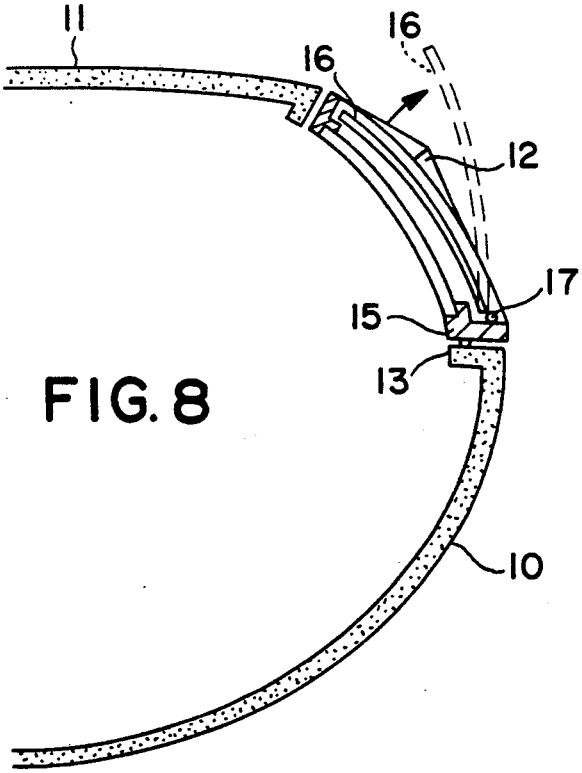
FIG. 8

PLEASURE BOAT WITH SAILS OR MOTOR

The invention relates to the technical sector of boat building.

Pleasure boats are built with a hull (1) made of all suitable materials, such as wood, plastic or others, the periphery of which is fitted out so as to take, by assembly, the deck (2), produced independently. The hull and deck are assembled along a parting line (3), as illustrated in FIG. 1, by bonding or any other known process. The parting line can be flat (4) (FIG. 2), curved towards the top (FIG. 3), according the reference (5), curved towards the bottom (FIG. 4) according to reference (6) or have an offset (7) (FIG. 5).

this assembly technique calls for the portholes (8) and other similar openings, either side of the parting line. Considering the profile of the deck part and surface of the hull above the load waterline, the surface and position of the portholes or other openings or transparent panels, are considerably limited and therefore, the attractiveness inside the boat.

The invention is aimed at overcoming these disadvantages.

The problem the invention offers to solve, is to create a new boat building design by giving them a new kind of attractiveness, greater visibility and improved attractiveness inside the boat.

Another problem the invention offers to solve, is to provide greater freedom of design and execution of portholes or other means of lighting.

Such problems are overcome in that the boat, which, in a known manner, comprises a hull and deck, separated by a parting plane, has, along the periphery of the parting line on the hull and/or deck, one or several profiled notches likely to define, in combination, by the bringing together and assembly of the hull and deck, an opening to take components forming a frame and fitted out to make up portholes.

Taking these characteristics into account, it therefore seems possible to separate the production of the simple shapes, such as those of the hull and deck, from more complex ones, such as the portholes. Therefore, the productivity conditions are increased.

According to a first embodiment, the problems brought up are solved in that the notches are made to oppose one another on the hull and deck by defining a double offset and are fitted out to take the component(s) forming a porthole support frame or transparent panels.

In another form of embodiment, the notches are made on the deck, the component(s) forming the frame being flush with the parting line of the hull.

Again, according to another embodiment, the notches are made on the hull, the components forming a frame being flush with the parting line of the deck.

In order to solve the problem brought up to provide the fixing of the components forming the frame of the portholes, the latter are assembled in the corresponding notches of the hull and/or deck, by bonding.

In an advantageous manner, in order to solve the problem brought up of rationalising the production, the components forming the frame, are integrated in the form of inserts during the production of the deck or hull, according to the profile of the latter in order to make up, with one or the other, one single part before the final assembly of the hull and the deck.

Another problem the invention offers to solve is to provide the opening of the porthole(s). Such a problem is solved in that the frame part is fitted with a porthole part, articulated at the base, by a hinge, providing opening from the top and ventilation.

In order to clarify the object of the invention, it is illustrated in a non-limitative manner by the drawings, where:

FIG. 1 is a perspective view before the deck is assembled on the hull of a boat according to the prior art, FIGS. 2, 3, 4 and 5 are schematic side views illustrating different positions of the parting line of a boat according to the prior art, FIG. 6 is a perspective view before the hull and deck are assembled according to the invention, FIG. 7 is a side view according to FIG. 6 after assembly, FIG. 8 is a partial, transversal section at the level of a porthole as designed according to the invention.

According to the invention, the periphery of the parting line of the hull (10) and/or deck (11) of the boat, has one or several profiled notches (10.1), (11.1), arranged opposite one another and likely to define an opening to take components (9) forming a frame, arranged so as to straddle or be in line with the parting line (12) defined by the hull and deck being brought together and assembled. The components (9) form a frame and are fitted so as to make up and take the porthole part or transparent panels of the boat.

As shown in the drawings, in one implementation where the notches are arranged on the deck and hull, the double offset, defined by the notches of the parting line between the hull and deck, enable the profile of the frame to be adapted. This profile can be very varied and provides a very clear increase in the potential visibility surface whilst being simultaneously distributed over the hull and deck. Therefore, as a function of the profile and characteristics of the boat, it may include one or several offset areas, with or without varied profiles.

As shown in FIG. 6, the frame (9) is, according to the profile of the deck in particular, substantially L-shaped or substantially flat and even-shaped (FIG. 7), or curved or other shapes. The frame may be cylindrical or define a rectangular or other type of surface. The porthole or transparent panel is directly integrated into the frame component according to known techniques. The frame is fixed by bonding or other assembly means and may form a draft in order to be assembled with the hull and deck. According to FIGS. 6 and 7, the frame component straddles the parting line.

Therefore, it appears that the frame component can be made with great precision and be provided with various fittings such as opening portholes, internal solar protections, ventilation louvres, integrated electric light fittings and others.

In a specific implementation, the frame component(s), produced separately, can be integrated in the form of inserts during the production of the deck or hull, according to the profile of the latter in order to make up, with one or the other, one single component before the final assembly of the hull and deck.

According to another alternative implementation of the invention, illustrated in FIG. 8, the frame component is flush with the parting line (13), particularly of the hull, whereas a notch has been made on the deck. The frame component (15) is assembled by the abovementioned means. The porthole part (16) can be mounted, articulated at the base, by a hinge (17), thereby enabling opening by the top and good ventilation. The receiver frame of the porthole has a curved profile, thereby reducing its projection with respect to the hull when it is opened.

As an alternative, the frame can be adapted to a notch made on the hull and be flush and applied against the opposite part of the deck.

The advantages are made well apparent from the invention. The new boat building design which offers a new kind of attractiveness, more attractive interior, greater visibility, more adapted production by optimising the production of simple shapes (hull and deck) from those of more complex and smaller parts made up by the frame structures.

What is claimed is:

1. A pleasure boat comprising a hull and deck separated by a parting line, wherein the periphery of the parting line has at least one profiled notch defining, in combination, by the bringing together and assembly of the hull and deck, an opening to take components forming a frame and fitted out so as to make up a porthole.

2. Boat according to claim 1, wherein the hull and deck are oppositely notched at the periphery of the parting line to define a double offset and are fitted out to take the components forming the frame.

3. Boat according to claim 1, wherein the at least one notch is made on the deck, the components forming the frame being flush with the parting line.

4. Boat according to claim 1, wherein the at least one notch is made on the hull, the components forming the frame being flush with the parting line.

5. Boat according to claim 1, wherein the components forming the frame are assembled by bonding.

6. Boat according to claim 1, wherein the components forming the frame are integrated in the form of inserts during the production of the deck according to a profile of the hull in order to make up one single part, before the final assembly of the hull and deck.

7. Boat according to claim 3, wherein the components forming the frame are fitted with a porthole part articulated at the base, by a hinge enabling opening from the top and ventilation.

8. The boat according to claim 1 wherein a transparent panel is substituted for the porthole.

9. The boat according to claim 2 wherein the components forming the support frame are assembled by bonding.

10. The boat according to claim 1 wherein the components forming the frame are integrated in the form of inserts during the production of the hull according to a profile of the hull in order to make up one single part before the final assembly of the hull and deck.

* * * * *